US011239573B2

(12) United States Patent
Shah et al.

(10) Patent No.: US 11,239,573 B2
(45) Date of Patent: Feb. 1, 2022

(54) SUB-MODULE L-SHAPED MILLIMETER WAVE ANTENNA-IN-PACKAGE

(71) Applicant: QUALCOMM Incorporated, San Diego, CA (US)

(72) Inventors: Milind Shah, San Diego, CA (US); Chin-Kwan Kim, San Diego, CA (US); Jaehyun Yeon, San Diego, CA (US); Rajneesh Kumar, San Diego, CA (US); Suhyung Hwang, Rancho Mission Viejo, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 16/886,086

(22) Filed: May 28, 2020

(65) Prior Publication Data

US 2021/0376493 A1 Dec. 2, 2021

(51) Int. Cl.

| | |
|---|---|
| ***H01Q 23/00*** | (2006.01) |
| ***H01Q 21/06*** | (2006.01) |
| ***H01Q 21/30*** | (2006.01) |
| ***H01Q 1/24*** | (2006.01) |
| ***H01Q 9/04*** | (2006.01) |

(52) U.S. Cl.

CPC ..... *H01Q 23/00* (2013.01); *H01Q 1/241* (2013.01); *H01Q 1/243* (2013.01); *H01Q 9/0414* (2013.01); *H01Q 21/065* (2013.01); *H01Q 21/068* (2013.01); *H01Q 21/30* (2013.01)

(58) Field of Classification Search

CPC ..... H01Q 1/243; H01Q 1/38; H01Q 1/2283; H01Q 21/065; H01Q 1/40; H01Q 9/0407; H01Q 1/2266; H01Q 21/00; H01Q 1/085; H01Q 1/523; H01Q 9/285; H01Q 23/00; H01Q 21/068; H01Q 21/30; H01L 2223/6677; H01L 23/5387; H01L 23/3121; H01L 23/5383; H01L 23/4985; H04M 1/0277; H04B 1/3833; H04B 7/0413; H04B 7/0608; H04B 7/0805

See application file for complete search history.

(56) References Cited

U.S. PATENT DOCUMENTS

| | | | | |
|---|---|---|---|---|
| 10,418,687 | B2 * | 9/2019 | Mow | H01Q 21/065 |
| 10,476,136 | B2 * | 11/2019 | Mow | H01Q 1/243 |
| 10,868,362 | B2 * | 12/2020 | Yun | H01Q 9/285 |
| 2020/0021015 | A1 * | 1/2020 | Yun | H01Q 21/24 |
| 2020/0266519 | A1 * | 8/2020 | Lee | H01Q 1/2283 |

* cited by examiner

*Primary Examiner* — Vibol Tan
(74) *Attorney, Agent, or Firm* — Seyfarth Shaw LLP

(57) ABSTRACT

An antenna-in-package (AiP) module is described. The AiP module includes an antenna sub-module. The antenna sub-module is composed of a first package substrate including an antenna side surface having a first group of antennas placed along a first portion of the antenna side surface and a second group of antennas placed along a second portion of the antenna side surface. The first package substrate is composed of a non-linear portion between the first group of antennas and the second group of antennas. The AiP module includes an active circuit sub-module placed on an active side surface of the first package substrate opposite the first group of antennas or the second group of antennas on the antenna side surface of the first package substrate.

17 Claims, 7 Drawing Sheets

SUB-MODULE L-SHAPED MILLIMETER WAVE ANTENNA-IN-PACKAGE

BACKGROUND

Field

The present disclosure relates generally to wireless communications and, more particularly, to a sub-module L-shaped millimeter wave (mmWave) antenna-in-package (AiP).

Background

Wireless communications may be transmitted over a multitude of different frequencies and bands. For example, communications may be transmitted using a mmWave signal (e.g., somewhere in the 24-60 gigahertz (GHz) range or higher). Such communications are, in some circumstances, transmitted across a large bandwidth. The large bandwidth enables wireless transmission of a high volume of information.

Facilitating mmWave applications involves developing circuits and antennas that operate in these frequency ranges. The various modules and circuits may be fabricated and packaged in any number of ways. The size of these circuits may vary.

In the consumer electronics market, the design of electronic devices, including the integrated radio frequency (RF) components, is generally dictated by cost, size, and weight, as well as performance specifications. It may be advantageous to further consider the current assembly of electronic devices, and particularly handheld devices, for enabling efficient transmission and reception of mmWave signals.

SUMMARY

An antenna-in-package (AiP) module is described. The AiP module includes an antenna sub-module. The antenna sub-module is composed of a first package substrate including an antenna side surface having a first group of antennas placed along a first portion of the antenna side surface and a second group of antennas placed along a second portion of the antenna side surface. The first package substrate is composed of a non-linear portion between the first group of antennas and the second group of antennas. The AiP module includes an active circuit sub-module placed on an active side surface of the first package substrate opposite the first group of antennas or the second group of antennas on the antenna side surface of the first package substrate.

An antenna-in-package (AiP) module is described. The AiP module includes an antenna sub-module. The antenna sub-module is composed of a first package substrate including an antenna side surface having a first group of antennas placed along a first portion of the antenna side surface and a second group of antennas placed along a second portion of the antenna side surface. The first package substrate is composed of means for bending between the first group of antennas and the second group of antennas. The AiP module includes an active circuit sub-module placed on an active side surface of the first package substrate opposite the first group of antennas or the second group of antennas on the antenna side surface of the first package substrate.

A method of fabricating an antenna-in-package (AiP) module is described. The method includes placing a first group of antennas along a first portion of an antenna side surface of a first package substrate. The method also includes placing a second group of antennas along a second portion of the antenna side surface of the first package substrate. The first package substrate is composed of a non-linear portion between the first group of antennas and the second group of antennas of an antenna sub-module. The method further includes forming an active circuit sub-module on an active side surface of the first package substrate opposite the first group of antennas or the second group of antennas on the antenna side surface of the first package substrate.

This has outlined, rather broadly, the features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

So that the manner in which the above-recited features of the present disclosure can be understood in detail, a more particular description, briefly summarized below, may be had by reference to aspects, some of which are illustrated in the appended drawings. It is to be noted, however, that the appended drawings illustrate only certain typical aspects of this disclosure and are therefore not to be considered limiting of its scope, for the description may admit to other equally effective aspects.

DETAILED DESCRIPTION

Figure 1:
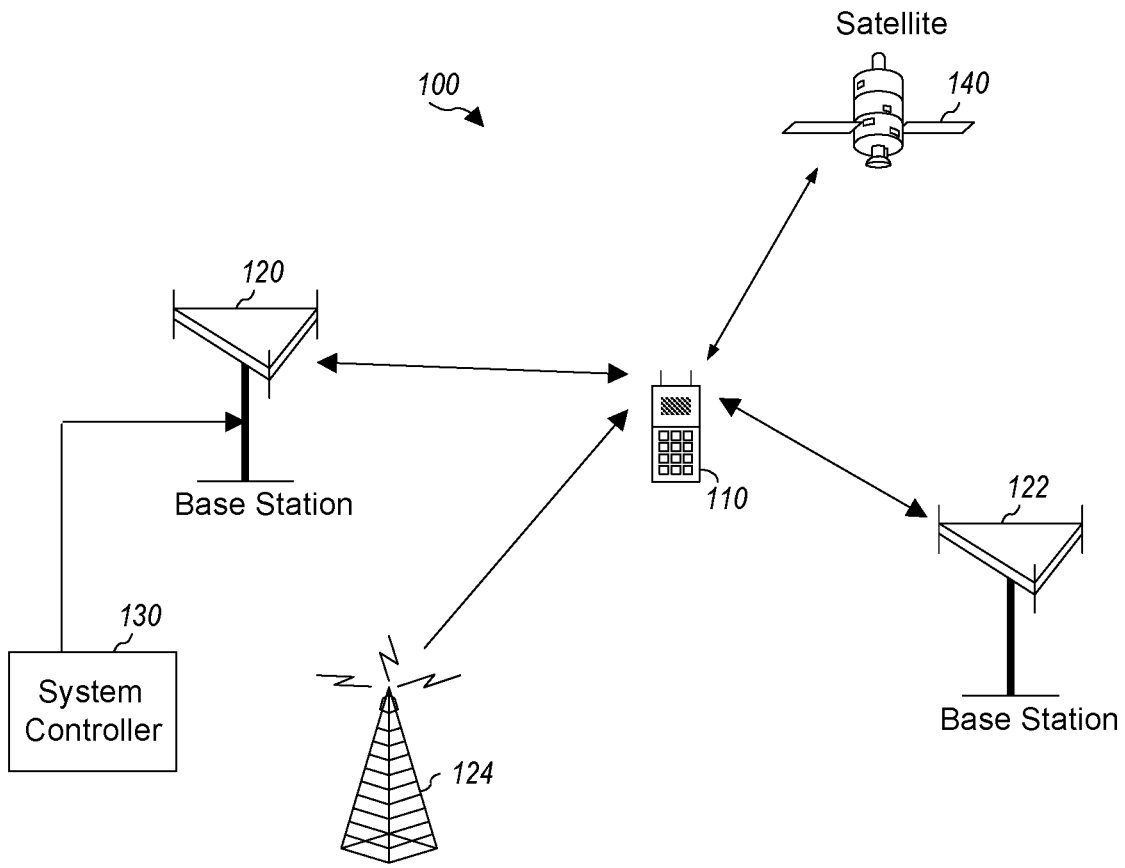
FIG. 1 illustrates a wireless device communicating with a wireless communications system, having an antenna-in-package (AiP) module that includes an antenna sub-module and an active circuit sub-module, according to aspects of the present disclosure

The detailed description set forth below, in connection with the appended drawings, is intended as a description of various configurations and is not intended to represent the only configurations in which the concepts described may be practiced. The detailed description includes specific details for the purpose of providing a thorough understanding of the various concepts. It will be apparent, however, to those skilled in the art that these concepts may be practiced without these specific details. In some instances, well-known structures and components are shown in block diagram form in order to avoid obscuring such concepts.

As described, the use of the term "and/or" is intended to represent an "inclusive OR," and the use of the term "or" is intended to represent an "exclusive OR." As described, the term "exemplary" used throughout this description means "serving as an example, instance, or illustration," and should not necessarily be construed as preferred or advantageous over other exemplary configurations. As described, the term "coupled" used throughout this description means "connected, whether directly or indirectly through intervening connections (e.g., a switch), electrical, mechanical, or otherwise," and is not necessarily limited to physical connections. Additionally, the connections can be such that the objects are permanently connected or releasably connected. The connections can be through switches. As described, the term "proximate" used throughout this description means "adjacent, very near, next to, or close to." As described, the term "on" used throughout this description means "directly on" in some configurations, and "indirectly on" in other configurations.

Wireless communications devices, which may include one or more transmitters and/or receivers, have one or more antennas capable of transmitting and receiving RF signals over a variety of wireless networks and associated bandwidths. These antennas may be for fifth generation (5G) new radio (NR) millimeter wave (mmWave) communications, wireless local area network (WLAN) communications (e.g., 802.11ad and/or 802.11ay), and/or other communications.

Designs for such mmWave antennas and integrated circuits (ICs) (e.g., radio frequency integrated circuits (RFICs), power management integrated circuits (PMICs), etc.) are desired. According to some aspects of the present disclosure, a mmWave antenna module integrates antennas and ICs (e.g., a PMIC and an RFIC) in a chip package. This integration may involve depositing a mold on the RFIC, the PMIC, and other circuitry to implement conformal shielding and reliability in the package. Notably, characteristics of epoxy-based molding compounds may result in significant loss in high frequency applications, such as 5G NR mmWave applications, which is referred to as a lossy mold effect.

Currently, a minimum of three mmWave antenna modules are specified for one phone to provide three to four directions of antenna coverage specified for supporting 5G NR mmWave applications. As a result, a minimum of three bill-of-material (BOM) sets (e.g., three substrates, three sets of active dies, and three sets of passive components) are specified per phone to support 5G NR mmWave applications. Furthermore, an electromagnetic interference (EMI) shield used in the mmWave antenna modules results in significant loss in high frequency applications due to epoxy-based molding compounds of the EMI shield.

In conventional configurations of antenna module packages, an electromagnetic interference shield is provided on an antenna side of the antenna module, which results in significant signal loss. Solutions for reducing loss in high frequency applications include reducing the amount of mold or avoiding depositing a mold directly on an antenna element(s). These solutions, however, may reduce the shielding and reliability in the package. As a result, it is desirable to limit the electromagnetic interference shield to an active module side of the current antenna module package structure, without reducing the shielding and reliability in the package.

Aspects of the present disclosure are directed to improvements in antenna systems, for example mmWave antenna systems, fifth generation (5G) new radio (NR) antenna systems ("5G NR antenna systems"), and/or WLAN antenna systems. Certain aspects relate to the design of an L-shaped antenna-in-package (AiP), in which four directions of antenna coverage are supported using two bill-of-material (BOM) sets rather than four BOM sets of conventional packages. In aspects of the present disclosure, a sub-module structure provides a selective EMI shield to maintain the shielding and reliability of the AiP module. In one configuration, the electromagnetic interference shield is placed on the active module side of the AiP module; however, an antenna side of the AiP module is free from the electromagnetic interference shield. This configuration provides improved performance, while maintaining the shielding and reliability of the AiP module. Aspects of the present disclosure provide flexibility to select either a wide L-shaped or finger (long) L-shaped rigid-flex antenna module.

According to aspects of the present disclosure, an AiP module includes an antenna sub-module and an active circuit sub-module. In one configuration, the antenna sub-module includes a first package substrate having an antenna side surface, including a first group of antennas placed along a first portion of the antenna side surface. The antenna sub-module also includes a second group of antennas placed along a second portion of the antenna side surface. In this configuration, the first package substrate includes a non-linear portion between the first group of antennas and the second group of antennas. The active circuit sub-module may be placed on an active side surface of the first package substrate. In this configuration, the active circuit sub-module is placed opposite either the first group of antennas or the second group of antennas on the antenna side surface of the first package substrate.

FIG. 1 illustrates a wireless device 110 communicating with a wireless communications system 100, having an antenna-in-package (AiP) module that includes an antenna sub-module and an active circuit sub-module, according to aspects of the present disclosure. Wireless communications system 100 may be a fifth generation (5G) new radio (NR) millimeter wave (mmWave) system, a long term evolution (LTE) system, a code division multiple access (CDMA) system, a global system for mobile communications (GSM) system, a wireless local area network (WLAN) system, or some other wireless system. A CDMA system may implement wideband CDMA (WCDMA), CDMA 1×, evolution-data optimized (EVDO), time division synchronous CDMA (TD-SCDMA), or some other version of CDMA. For simplicity, FIG. 1 shows wireless communications system 100, including two base stations 120 and 122, and one system controller 130. In general, a wireless system may include any number of base stations and any set of network entities.

In some embodiments, one or more of the base stations are implemented as access points, for example, as might be implemented in a Wi-Fi system. The wireless device 110 may communicate at separate times with two or more of the systems listed above, or may concurrently communicate with several systems.

The wireless device 110 may also be referred to as user equipment (UE), a mobile station, a mobile device, a terminal, an access terminal, a subscriber unit, a station, etc. The wireless device 110 may be a cellular phone, a smartphone, a tablet, a wireless modem, a personal digital assistant (PDA), a handheld device, a laptop computer, a Smartbook, a netbook, a cordless phone, a wireless local loop (WLL) station, a Bluetooth® device, a medical device, an apparatus communicating with the Internet of Things (IoT), etc. The wireless device 110 may communicate with wireless communications system 100. The wireless device 110 may also receive signals from broadcast stations (e.g., broadcast station 124), signals from satellites (e.g., satellite 140) in one or more global navigation satellite systems (GNSS), etc. The wireless device 110 may support one or more radio technologies for wireless communications including LTE, WCDMA, CDMA 1×, EVDO, TD-SCDMA, GSM, 802.11, 5G (e.g., mmWave systems), etc.

Figure 2:
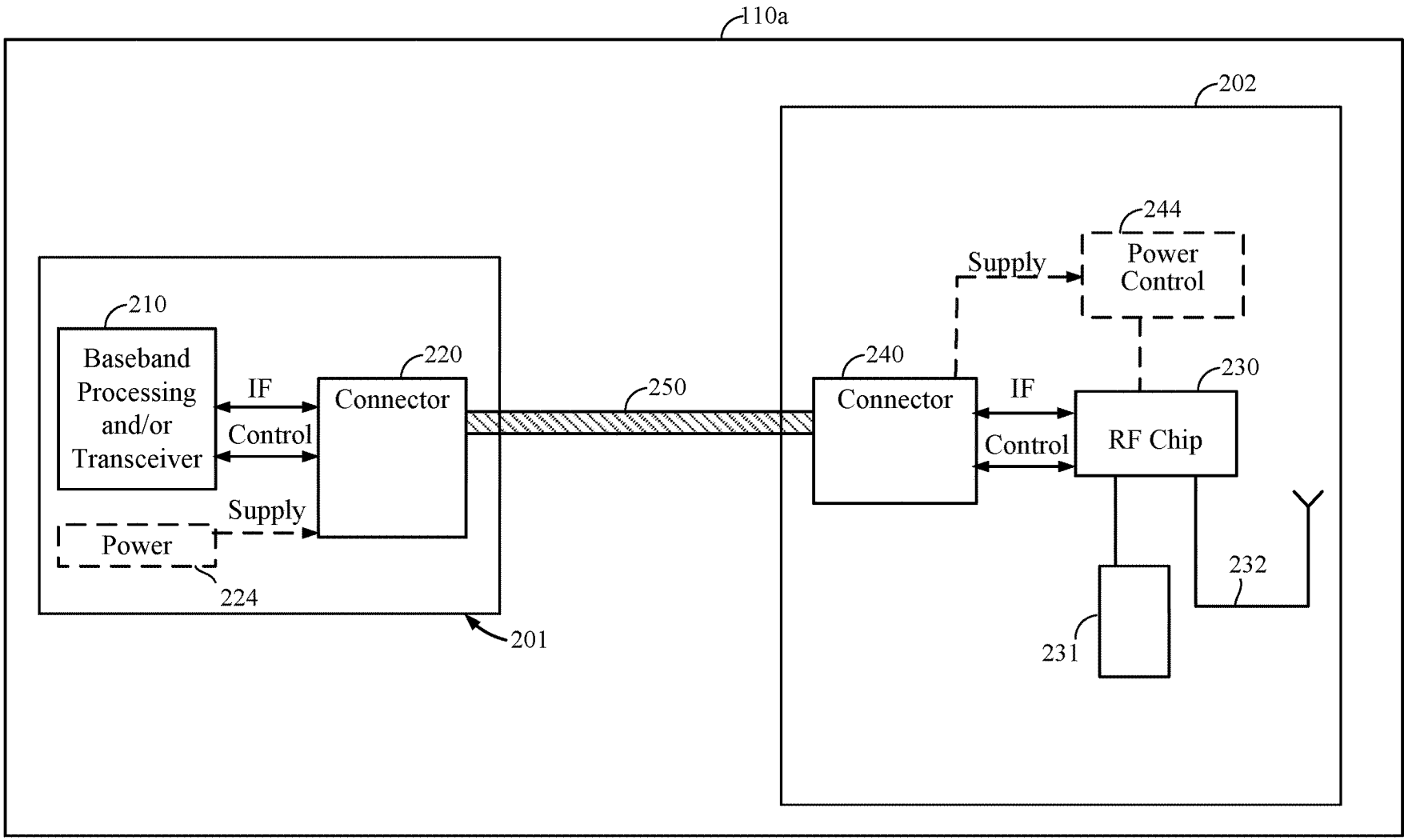
FIG. 2 illustrates a block diagram of the wireless device shown in FIG. 1.

FIG. 2 illustrates an example 110*a* of the wireless device 110 described in FIG. 1. The wireless device 110*a* includes baseband processing and/or transceiver elements 210 coupled to a connector 220. The transceiver elements 210 may include a baseband chip configured to process data and provide digital signals to a transceiver chip configured to convert those digital signals into analog intermediate frequency (IF) signals. The baseband chip and/or the transceiver chip of the transceiver elements 210 may provide both the IF signals to the connector 220 for transmission and control signals to the connector 220. Further, the transceiver elements 210 may receive IF signals through the connector 220 and may additionally downconvert these signals and provide corresponding digital signals to the baseband chip for processing. The transceiver elements 210 may also provide a local oscillator (LO) signal (not illustrated) to the connector 220. The LO signal may be separate from or combined with the IF signal, for example, as described in greater detail below.

In the configuration illustrated in FIG. 2, the wireless device 110*a* further includes a power source 224 coupled to the connector 220. The power source 224 may be any element configured to provide power or a supply voltage (e.g., Vdd). For example, the power source 224 may be a battery, an input coupled to a power input, such as a USB input or a wireless charging input, a power management integrated circuit (PMIC), or a combination of these elements or other elements.

The transceiver elements 210, including the baseband chip and/or the transceiver chip, the connector 220, and/or the power source 224 may be arranged on a board 201 (e.g., a circuit board and/or a phone board). For example, chips, dies, and/or modules implementing these elements may be coupled together with traces on a printed circuit board (PCB).

The wireless device 110*a* may further include radio frequency (RF) processing elements (e.g., an RF chip 230) coupled to a connector 240. The RF circuitry may perform up-conversion of signals based on the IF signals and the control signals from the connector 240 and down-conversion of received signals. The RF processing elements of the RF chip 230 may be coupled to antennas 231 and 232 for transmission and reception of wireless signals. While two antennas are illustrated in FIG. 2, those of skill in the art will understand that additional or fewer antennas may be implemented. In an aspect of the present disclosure, one or more of the implemented antennas includes a phased array antenna. The wireless device 110*a* may enable efficient transmission and reception of signals having a millimeter wavelength, for example in at least the 24-40 GHz range (e.g., 28 GHz, 39 GHz, etc.), 60 GHz range, or higher.

In the configuration illustrated in FIG. 2 the wireless device 110*a* further includes a power management integrated circuit (PMIC) 244. The PMIC 244 receives the supply voltage from the connector 240 and is configured to convert the supply voltage into several different voltages for use by components of the RF processing elements of the RF chip 230. The transceiver elements 210 and the RF processing elements of the RF chip 230 may be spaced apart from each other and connected using a communications cable 250 (or multiple transmission lines), for example, through the connector 220 and the connector 240.

The RF processing elements of the RF chip 230, the connector 240, the PMIC 244, and/or the antennas 231, 232 may be arranged on a circuit board or substrate or integrated in a module 202. For example, chips and/or dies implementing these elements may be implemented in a module or chip as described below. According to aspects of the present disclosure, the module 202 is implemented using an AiP module, including an antenna sub-module and an active circuit sub-module, for example, as shown in FIG. 3.

Figure 3:
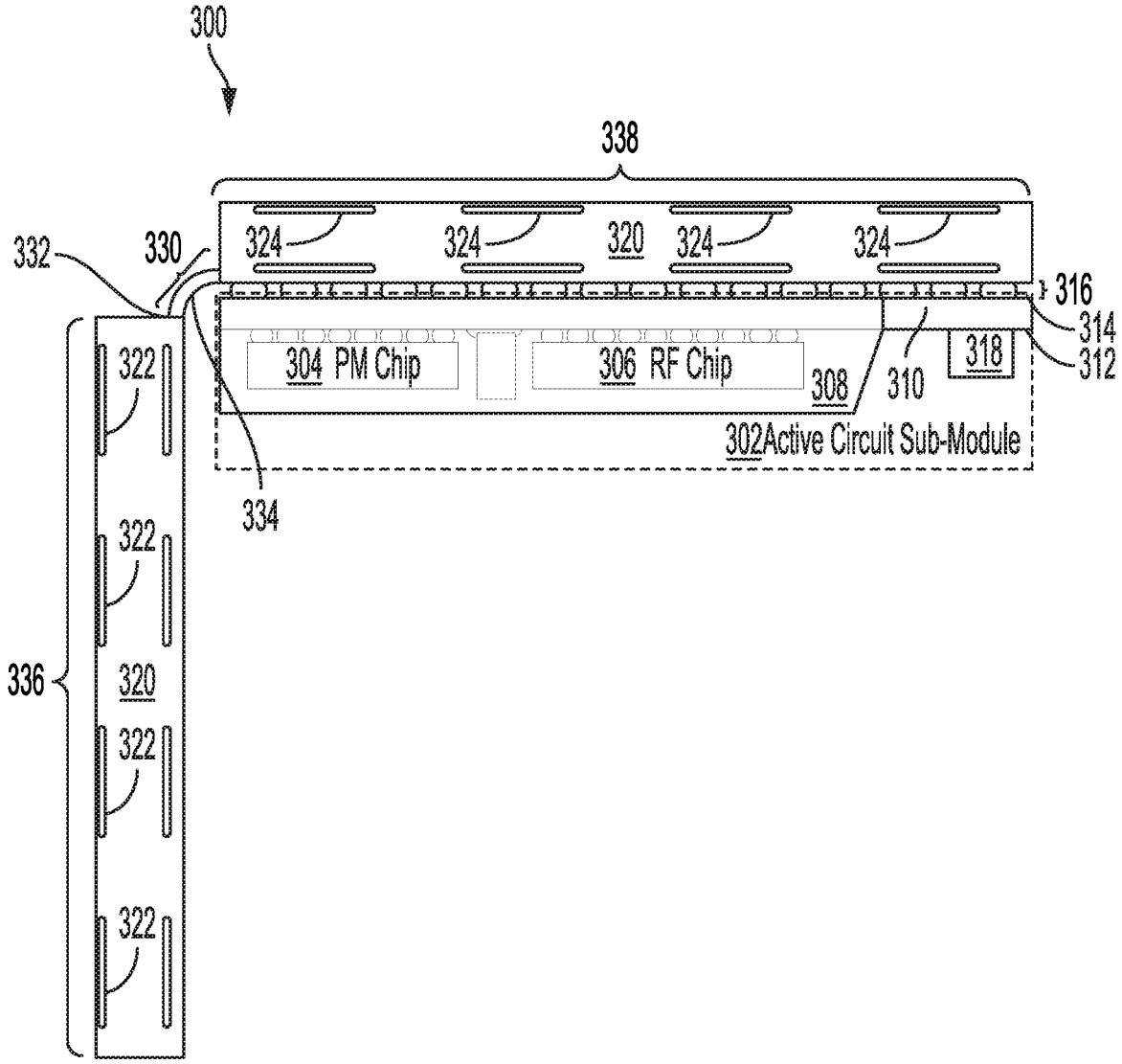
FIG. 3 illustrates a side view of an antenna-in-package (AiP) module, including an antenna sub-module and an active circuit sub-module, according to aspects of the present disclosure.

FIG. 3 illustrates a side view of an antenna-in-package (AiP) module 300, including an antenna sub-module 320 and an active circuit sub-module 302, according to aspects of the present disclosure. In one configuration, the antenna sub-module 320 includes a first package substrate 330 having an antenna side surface 332, including a first group of antennas 322 placed along a first portion 336 of the antenna side surface 332. The antenna sub-module 320 also includes a second group of antennas 324, placed along a second portion 338 of the antenna side surface 332 of the first package substrate 330. In aspects of the present disclosure, the antenna sub-module may be implemented using a flexible antenna printed circuit board (PCB).

In this example, the first package substrate 330 is shown in an L-shaped configuration, including a non-linear or curved portion (e.g., a ninety degree bend) between the first group of antennas 322 and the second group of antennas 324. This configuration enables the AiP module 300 to support two different antenna directions using a single one of the active circuit sub-module 302. For example, the first group of antennas 322 and the second group of antennas 324 are composed of patch antennas (or dipole antennas) to cover a first antenna direction and a second antenna direction orthogonal to the first direction based on the L-shaped configuration. In this example, the patch antennas of the first group of antennas 322 and the second group of antennas 324 are shown in a one by four (1×4) configuration. It should be recognized that other configurations of the patch antennas (e.g., 2×2, 1×5, etc.) are contemplated by aspects of the present disclosure.

According to this aspect of the present disclosure, the active circuit sub-module 302 is placed on an active side surface 334 of the first package substrate 330. In this configuration, the active circuit sub-module 302 is placed opposite the second group of antennas 324, which are on the antenna side surface 332 of the first package substrate 330. In this example, the active circuit sub-module 302 includes a second package substrate 310 (e.g., a printed circuit board (PCB)), including a connector 318 on an active surface 312 of the second package substrate 310. The active circuit sub-module 302 includes a radio frequency (RF) chip 306 on the active surface 312 of the second package substrate 310, and a power management (PM) chip 304 on the active surface 312 of the second package substrate 310. Although shown in a rectangular shape, the active circuit sub-module 302 may be configured according to an oblong shape, a square shape, or other like non-rectangular shape.

In this aspect of the present disclosure, an electromagnetic interference shield 308 is deposited on the active surface 312 of the second package substrate 310 to encapsulate the RF chip 306 and the PM chip 304. Package balls 316 (e.g., a ball grid array (BGA)/land grid array (LGA)) are also shown on a passive surface 314 of the second package substrate 310 to couple the active circuit sub-module 302 to the active side surface 334 of the first package substrate 330. This configuration places the electromagnetic interference shield 308 on the active side surface 334 of the first package substrate 330, away from the second group of antennas 324 on the antenna side of the first package substrate 330. In this configuration, the antenna side surface 332 of first package substrate 330 of the AiP module 300 is free from the electromagnetic interference shield 308. This configuration improves performance, while maintaining the shielding and reliability of the AiP module 300. This aspect of the present disclosure provides flexibility to select either a wide L-shaped or finger (long) L-shaped rigid-flex antenna module as the first package substrate 330.

In this configuration, the PM chip 304 may be configured according to the PMIC 244, and the RF chip 306 may be configured according to the RF chip 230, as shown in FIG. 2. The PM chip 304 and the RF chip 306 enable the first group of antennas 322 and the second group of antennas 324 to support fifth generation (5G) new radio (NR) millimeter wave (mmWave) communications, as further illustrated in FIGS. 4 and 5.

Figure 4:
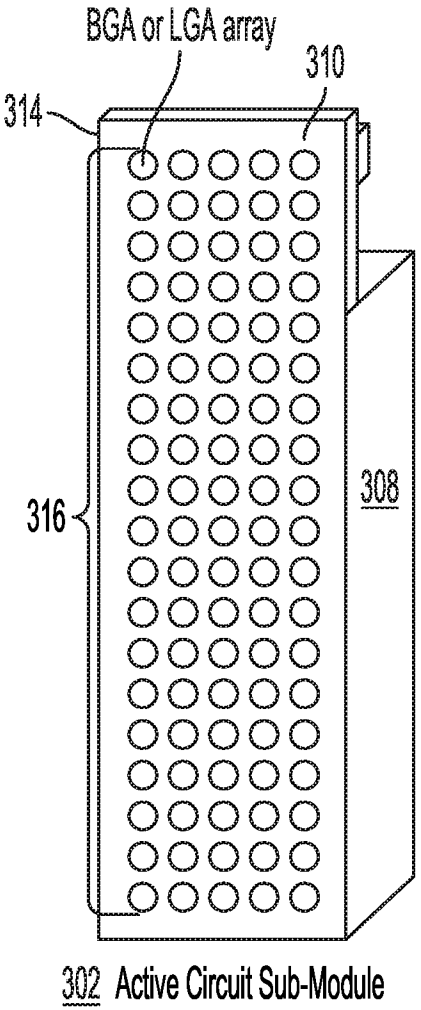
FIG. 4 illustrates a perspective view of the active circuit sub-module of FIG. 3, according to further aspects of the present disclosure.

FIG. 4 illustrates a perspective view of the active circuit sub-module 302 of FIG. 3, according to further aspects of the present disclosure. In this configuration, the active circuit sub-module 302 is shown in an upright view, further illustrating the passive surface 314 of the second package substrate 310. The passive surface 314 of the second package substrate 310 includes package balls 316, which may be implemented using package interconnects, such as a ball grid array (BGA) or a land grid array (LGA) depending on the desired implementation. In addition, the electromagnetic interference shield 308 is on the active surface 312 of the second package substrate 310 to encapsulate the RF chip 306 and the PM chip 304 (not shown).

Figure 5:
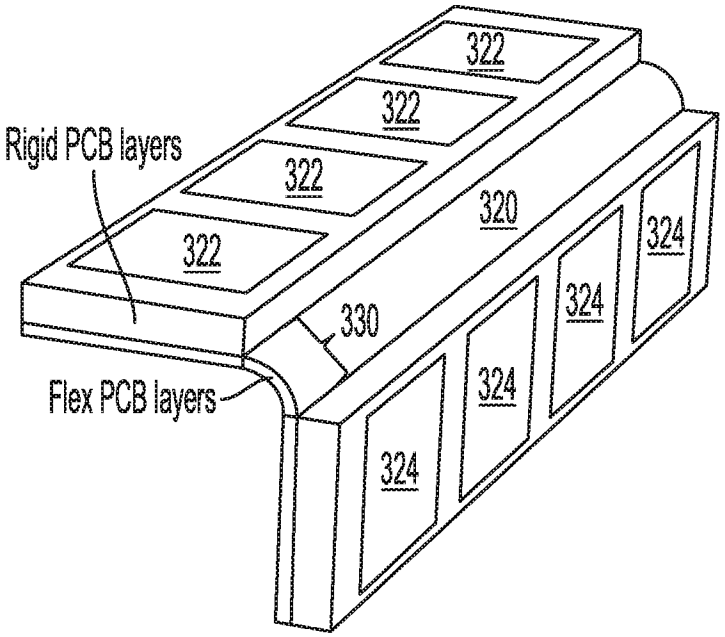
FIG. 5 illustrates a perspective view of the antenna sub-module of FIG. 3, according to further aspects of the present disclosure.

FIG. 5 illustrates a perspective view of the antenna sub-module 320 of FIG. 3, according to further aspects of the present disclosure. In this configuration, the antenna sub-module 320 is shown without the active circuit sub-module 302 to further illustrate the antenna side surface 332 of the first package substrate 330. The first package substrate 330 is composed of flexible printed circuit board (PCB) layers and rigid PCB layers in this L-shaped rigid-flex PCB configuration. This configuration enables simplified placement of the AiP module 300 within, for example, the wireless device 110, as shown in FIG. 1. Alternatively, the first package substrate 330 is composed of L-shaped, rigid PCB layers or solely from flexible PCB layers. In this example, the non-linear portion of the first package substrate 330 is composed of an exposed portion of the antenna side surface 332 and an exposed portion of the active side surface 334, opposite the antenna side surface 332. The active circuit sub-module 302 may be mounted on the antenna sub-module 320, as shown in FIG. 6.

Figure 6:
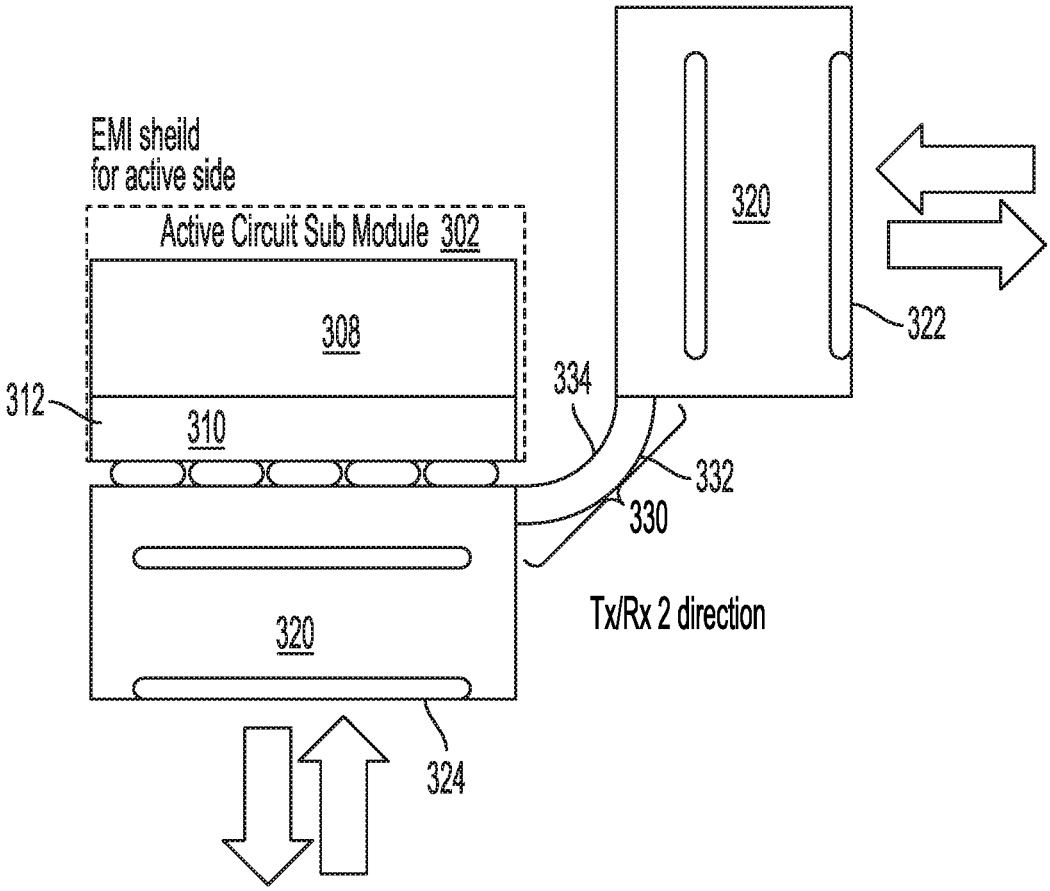
FIG. 6 illustrates a side view of the antenna-in-package (AiP) module of FIG. 3, according to further aspects of the present disclosure.

FIG. 6 illustrates a side view of the AiP module 300 of FIG. 3, according to further aspects of the present disclosure. In this configuration, the electromagnetic interference shield 308 is deposited on the active surface 312 of the second package substrate 310. This configuration places the electromagnetic interference shield 308 on the active side surface 334 of the first package substrate 330, away from the second group of antennas 324 on the antenna side surface 332 of the first package substrate 330. In this configuration, the antenna side surface 332 of the first package substrate 330 of the AiP module 300 is free from the electromagnetic interference shield 308. This configuration improves performance, while maintaining the shielding and reliability of the AiP module 300.

One of skill in the art will appreciate that while a certain number of the first group of antennas 322 and the second group of antennas 324, or other elements, are illustrated in FIGS. 3-6, different numbers of such antennas or elements may be implemented. Further, other shapes, sizes, components, and configurations may be utilized. Other potential configurations are also contemplated according to further aspects of the present disclosure. For example, a second AiP module may be placed at a different edge of a user equipment (UE) (e.g., the wireless device 110 of FIG. 1) to cover four antenna directions.

Aspects of the present disclosure integrate the antenna sub-module 320 and active circuit sub-module 302 incorporating the RF chip 306 and the PM chip 304, and the first group of antennas 322 and the second group of antennas 324 for supporting 5G NR mmWave communications and/or WLAN applications. As described above, this integration involves depositing the electromagnetic interference shield 308 on the RF chip 306 and the PM chip 304 to implement conformal shielding and reliability in the AiP module 300, as shown in FIGS. 3-6. This configuration prevents characteristics of molding compounds of the electromagnetic interference shield 308 from causing significant loss in high frequency applications, such as 5G NR mmWave communications and/or WLAN applications.

Figure 7:
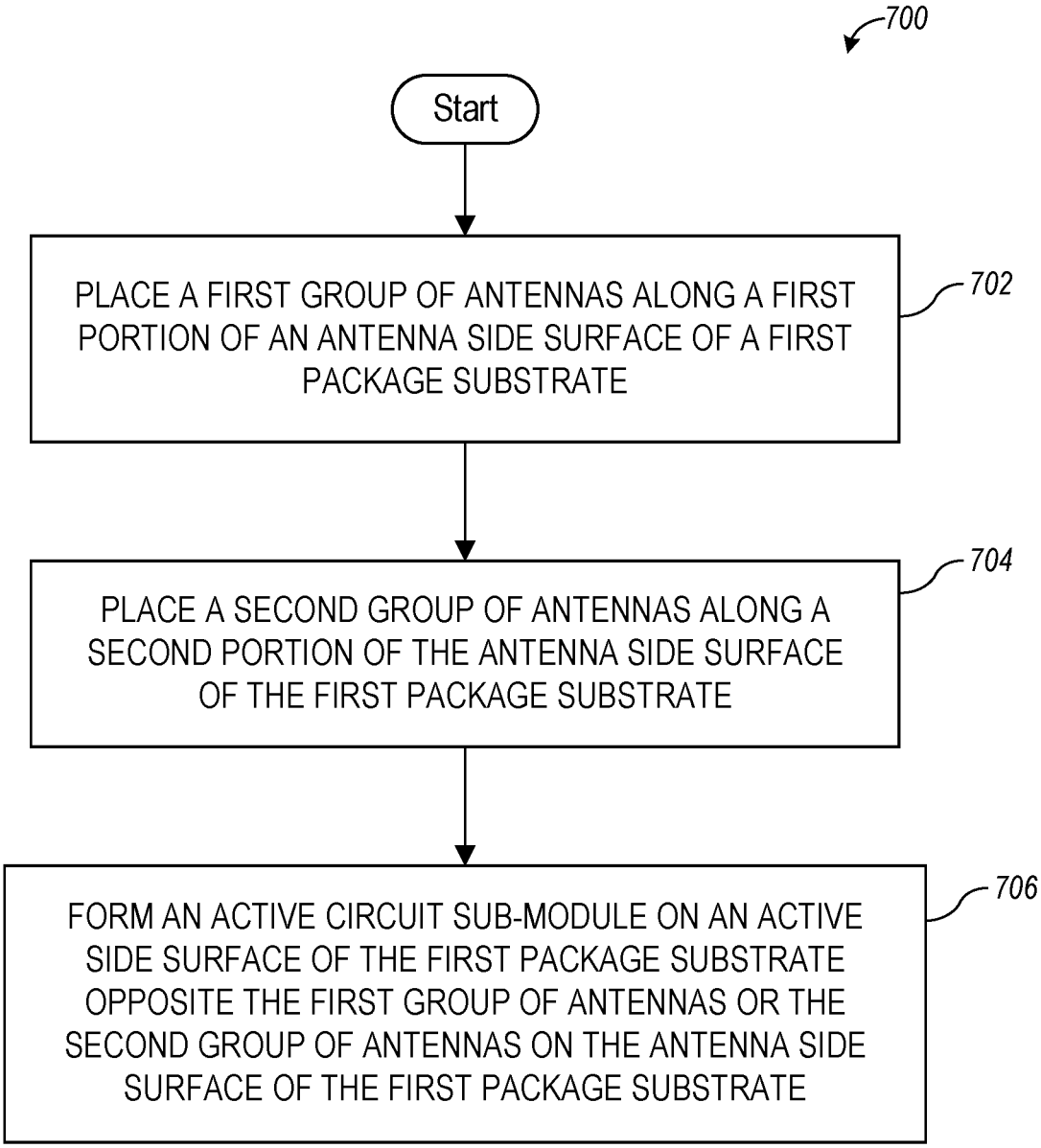
FIG. 7 is a flowchart illustrating a method of fabricating an antenna-in-package (AiP) module, in accordance with an aspect of the present disclosure.

FIG. 7 is a flowchart illustrating a method of fabricating an antenna-in-package (AiP) module, in accordance with an aspect of the present disclosure. A method 700 begins at block 702, in which a first group of antennas are placed along a first portion of an antenna side surface of a first package substrate. For example, as shown in FIG. 3, the antenna sub-module 320 includes a first package substrate 330 having an antenna side surface 332, including a first group of antennas 322 placed along a first portion 336 of the antenna side surface 332. At block 704, a second group of antennas is placed along a second portion of the antenna side surface of the first package substrate. For example, as shown in FIG. 3, the antenna sub-module 320 also includes a second group of antennas 324, placed along a second portion 338 of the antenna side surface 332 of the first package substrate 330. In this example, the first package substrate 330 is shown in an L-shaped configuration, including a curved portion between the first group of antennas 322 and the second group of antennas 324.

Referring again to FIG. 7, at block 706, an active circuit sub-module is formed on an active side surface of the first package substrate opposite the first group of antennas or the second group of antennas on the antenna side surface of the first package substrate. For example, as shown in FIG. 6, the active circuit sub-module 302 is placed on the active side surface 334 of the first package substrate 330. In this configuration, the active circuit sub-module 302 is placed opposite the second group of antennas 324, which are on the antenna side surface 332 of the first package substrate 330. This configuration places the active circuit sub-module 302 on the active side surface 334 of the first package substrate 330, away from the second group of antennas 324 on the antenna side surface 332 of the first package substrate 330. In this configuration, the antenna side surface 332 of the first package substrate 330 of the AiP module 300 is free from the electromagnetic interference shield 308. This configuration improves performance, while maintaining the shielding and reliability of the AiP module 300.

According to a further aspect of the present disclosure, a 5G mmWave AiP module or WLAN mmWave AiP module is described. Such 5G mmWave AiP module may include an antenna sub-module, including a first package substrate, having an antenna side surface having a first group of antennas placed along a first portion of the antenna side surface and a second group of antennas placed along a second portion of the antenna side surface, in which the first package substrate comprises means for bending between the first group of antennas and the second group of antennas. The means for bending may, for example, include the non-linear portion of the first package substrate 330, as shown in FIGS. 3, 5, and 6. In another aspect, the aforementioned means may be any module, or any apparatus configured to perform the functions recited by the aforementioned means.

Figure 8:
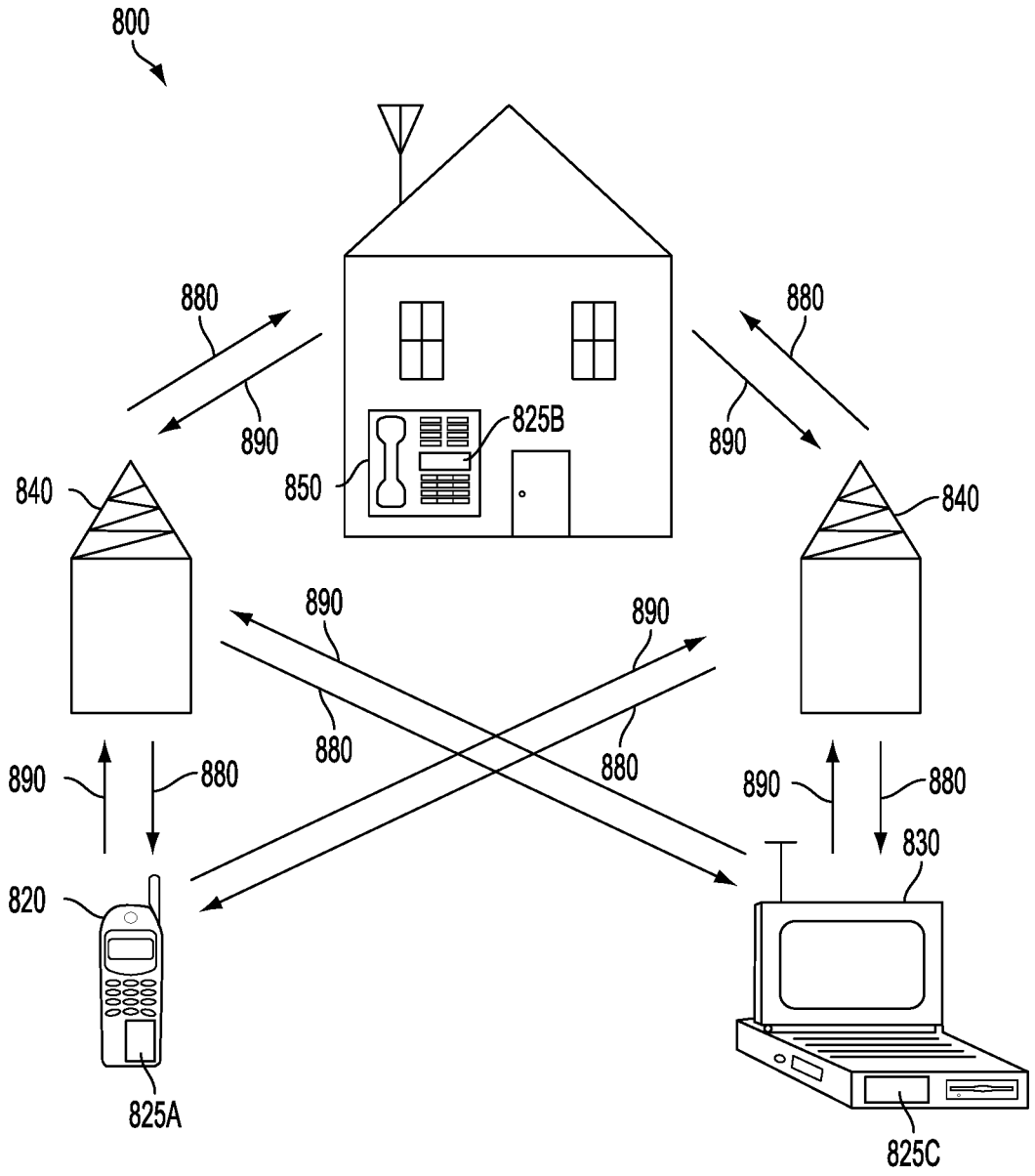
FIG. 8 is a block diagram showing an exemplary wireless communications system in which an aspect of the present disclosure may be advantageously employed.

FIG. 8 is a block diagram showing an exemplary wireless communications system 800 in which an aspect of the present disclosure may be advantageously employed. For purposes of illustration, FIG. 8 shows three remote units 820, 830, and 850, and two base stations 840. It will be recognized that wireless communications systems may have many more remote units and base stations. Remote units 820, 830, and 850 include IC devices 825A, 825B, and 825C that include the disclosed AiP module. It will be recognized that other devices may also include the disclosed AiP module, such as the base stations, user equipment, and network equipment. FIG. 8 shows forward link signals 880 from the base stations 840 to the remote units 820, 830, and 850, and reverse link signals 890 from the remote units 820, 830, and 850 to the base stations 840.

In FIG. 8, remote unit 820 is shown as a mobile telephone, remote unit 830 is shown as a portable computer, and remote unit 850 is shown as a fixed location remote unit in a wireless local loop system. For example, a remote unit may be a mobile phone, a hand-held personal communications systems (PCS) unit, a portable data unit such as a personal digital assistant (PDA), a GPS enabled device, a navigation device, a set top box, a music player, a video player, an entertainment unit, a fixed location data unit such as meter reading equipment, or other communications device that stores or retrieves data or computer instructions, or combinations thereof. Although FIG. 8 illustrates remote units according to the aspects of the present disclosure, the present disclosure is not limited to these exemplary illustrated units. Aspects of the present disclosure may be suitably employed in many devices, which include the disclosed AiP module.

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Several aspects of radio frequency (RF) communications systems were presented with reference to various apparatus and methods. These apparatus and methods are described in the following detailed description and illustrated in the accompanying drawings by various blocks, modules, components, circuits, steps, processes, algorithms, etc. (collectively referred to as "elements"). These elements may be implemented using hardware, software, or combinations thereof. Whether such elements are implemented as hardware or software depends upon the particular application and design constraints imposed on the overall system.

By way of example, an element, or any portion of an element, or any combination of elements may be implemented with a "processing system" that includes one or more processors. Examples of processors include microprocessors, microcontrollers, digital signal processors (DSPs), field-programmable gate arrays (FPGAs), programmable logic devices (PLDs), state machines, gated logic, discrete hardware circuits, and other suitable hardware configured to perform the various functionality described throughout this disclosure. One or more processors in the processing system may execute software. Software shall be construed broadly to mean instructions, instruction sets, code, code segments, program code, programs, subprograms, software modules, applications, software applications, software packages, firmware, routines, subroutines, objects, executables, threads of execution, procedures, functions, etc., whether referred to as software/firmware, middleware, microcode, hardware description language, or otherwise.

Accordingly, in one or more exemplary aspects, the functions described may be implemented in hardware, software, or combinations thereof. If implemented in software, the functions may be stored on or encoded as one or more instructions or code on a computer-readable medium. Computer-readable media includes computer storage media. Storage media may be any available media that can be accessed by a computer. By way of example, and not limitation, such computer-readable media can comprise RAM, ROM, EEPROM, phase change memory (PCM), flash memory, CD-ROM or other optical disk storage, magnetic disk storage or other magnetic storage devices, or any other medium that can be used to carry or store desired program code in the form of instructions or data structures and that can be accessed by a computer. Disk and disc, as used, include compact disc (CD), laser disc, optical disc, digital versatile disc (DVD), floppy disk and Blu-ray® disc, where disks usually reproduce data magnetically, while discs reproduce data optically with lasers. Combinations of the above should also be included within the scope of computer-readable media.

Moreover, the term "or" is intended to mean an inclusive "or" rather than an exclusive "or." That is, unless specified otherwise or clear from the context, the phrase, for example, "X employs A or B" is intended to mean any of the natural inclusive permutations. That is, for example the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. A phrase referring to "at least one of" a list of items refers to any combination of those items, including single members. As an example, "at least one of: a, b, or c" is intended to cover: a, b, c, a-b, a-c, b-c, and a-b-c.

The previous description is provided to enable any person skilled in the art to practice the various aspects described.

Various modifications to these aspects will be readily apparent to those skilled in the art, and the generic principles defined may be applied to other aspects. Thus, the claims are not intended to be limited to the aspects shown, but is to be accorded the full scope consistent with the language of the claims, in which reference to an element in the singular is not intended to mean "one and only one" unless specifically so stated, but rather "one or more." Unless specifically stated otherwise, the term "some" refers to one or more. All structural and functional equivalents to the elements of the various aspects described throughout this disclosure that are known or later come to be known to those of ordinary skill in the art are expressly incorporated by reference and are intended to be encompassed by the claims. Moreover, nothing disclosed is intended to be dedicated to the public regardless of whether such disclosure is explicitly recited in the claims.

What is claimed is:

1. An antenna-in-package (AiP) module, comprising:

an antenna sub-module, comprising a first package substrate including an antenna side surface having a first group of antennas placed along a first portion of the antenna side surface and a second group of antennas placed along a second portion of the antenna side surface, in which the first package substrate comprises a non-linear portion between the first group of antennas and the second group of antennas; and an active circuit sub-module placed on an active side surface of the first package substrate opposite the first group of antennas or the second group of antennas on the antenna side surface of the first package substrate, in which the active circuit sub-module comprises:

a second package substrate, a radio frequency integrated circuit (RFIC) on an active surface of the second package substrate and/or a power management integrated circuit (PMIC) on the active surface of the second package substrate, an electromagnetic interference shield on the active surface of the second package substrate and encapsulating the RFIC and/or the PMIC, and package interconnects on a passive surface of the second package substrate to couple the active surface of the first package substrate.

2. The AiP module of claim 1, in which the first package substrate comprises flexible printed circuit board (PCB) layers.

3. The AiP module of claim 1, in which the first package substrate comprises L-shaped, rigid printed circuit board (PCB) layers.

4. The AiP module of claim 1, in which the first group of antennas and the second group of antennas comprise patch antennas to cover a first antenna direction and a second antenna direction.

5. The AiP module of claim 1, in which the non-linear portion of the first package substrate comprises an exposed portion of the antenna side surface and an exposed portion of the active side surface opposite the antenna side surface.

6. The AiP module of claim 1, in which the package interconnects comprise a ball grid array coupling the passive surface of the second package substrate to the active surface of the first package substrate.

7. The AiP module of claim 1, in which the second package substrate comprises a printed circuit board (PCB).

8. The AiP module of claim 1, in which the first group of antennas and the second group of antennas comprise dipole antennas to cover a first antenna direction and a second antenna direction.

9. The AiP module of claim 1, further comprising a second AiP module placed at a different edge of a user equipment to cover four antenna directions.

10. An antenna-in-package (AiP) module, comprising:

an antenna sub-module, comprising a first package substrate including an antenna side surface having a first group of antennas placed along a first portion of the antenna side surface and a second group of antennas placed along a second portion of the antenna side surface, in which the first package substrate comprises means for bending between the first group of antennas and the second group of antennas; and an active circuit sub-module placed on an active side surface of the first package substrate opposite the first group of antennas or the second group of antennas on the antenna side surface of the first package substrate, in which the active circuit sub-module comprises:

a second package substrate, a radio frequency integrated circuit (RFIC) on an active surface of the second package substrate and/or a power management integrated circuit (PMIC) on the active surface of the second package substrate, an electromagnetic interference shield on the active surface of the second package substrate and encapsulating the RFIC and/or the PMIC, and package interconnects on a passive surface of the second package substrate to couple the active surface of the first package substrate.

11. The AiP module of claim 10, in which the first group of antennas and the second group of antennas comprise patch antennas to cover a first antenna direction and a second antenna direction.

12. The AiP module of claim 10, in which the package interconnects comprise a ball grid array coupling the passive surface of the second package substrate to the active surface of the first package substrate.

13. The AiP module of claim 10, in which the second package substrate comprises a printed circuit board (PCB).

14. The AiP module of claim 10, in which the first group of antennas and the second group of antennas comprise dipole antennas to cover a first antenna direction and a second antenna direction.

15. The AiP module of claim 10, further comprising a second AiP module placed at a different edge of a user equipment to cover four antenna directions.

16. A method of fabricating an antenna-in-package (AiP) module, the method comprising:

placing a first group of antennas along a first portion of an antenna side surface of a first package substrate;

placing a second group of antennas along a second portion of the antenna side surface of the first package substrate, in which the first package substrate comprises a non-linear portion between the first group of antennas and the second group of antennas of an antenna sub-module; and forming an active circuit sub-module on an active side surface of the first package substrate opposite the first group of antennas or the second group of antennas on the antenna side surface of the first package substrate by:

forming a radio frequency integrated circuit (RFIC) on an active surface of a second package substrate and/or a power management integrated circuit (PMIC) on the active surface of the second package substrate, forming an electromagnetic interference shield on the active surface of the second package substrate and encapsulating the RFIC and/or the PMIC, and forming package interconnects on a passive surface of the second package substrate to couple the active surface of the first package substrate.

17. The method of claim 16, in which the first group of antennas and the second group of antennas are placed to cover a first antenna direction and a second antenna direction.

* * * * *